United States Patent [19]

Rowland et al.

[11] Patent Number: 4,516,677

[45] Date of Patent: May 14, 1985

[54] MODULAR PALLET AND SHIPPING TRAY

[75] Inventors: Nelson Rowland, Asheboro; Robert D. Getto, Greensboro, both of N.C.

[73] Assignee: Burlington Industries, Inc., Greensboro, N.C.

[21] Appl. No.: 560,501

[22] Filed: Dec. 12, 1983

[51] Int. Cl.[3] ..... B65D 71/00

[52] U.S. Cl. ..... 206/394; 206/499; 206/391; 206/595; 242/132; 108/53.1; 108/55.3

[58] Field of Search ..... 242/129, 129.5, 132, 242/137, 130.3; 108/53.1, 53.3, 55.3, 51; 206/386, 595, 596, 509, 499, 557, 567, 394, 391

[56] References Cited

U.S. PATENT DOCUMENTS

| | | | |
|---|---|---|---|
| 3,495,705 | 2/1970 | Limbacher | 206/599 |
| 3,526,195 | 9/1970 | Maryonovich | 108/53 |
| 3,563,184 | 2/1971 | Angelbeck | 108/58 |
| 3,611,952 | 10/1971 | Hoffman | 108/51 |
| 3,636,888 | 1/1972 | Angelbeck | 108/51 |
| 3,695,188 | 10/1972 | Granastein | 108/58 |
| 3,730,340 | 5/1973 | Neubert | 206/386 |
| 3,944,070 | 3/1976 | Cardwell et al. | 206/386 |
| 3,948,190 | 4/1976 | Cook et al. | 206/599 |
| 4,000,704 | 1/1977 | Griffin, Jr. | 108/53.1 |
| 4,202,448 | 5/1980 | Jaeger et al. | 206/392 |
| 4,254,873 | 3/1981 | Cook et al. | 206/599 |
| 4,263,855 | 4/1981 | Lawlor | 108/53.3 |
| 4,283,570 | 3/1981 | O'Connor et al. | 206/391 |

FOREIGN PATENT DOCUMENTS

| | | | |
|---|---|---|---|
| 1913646 | 10/1969 | Fed. Rep. of Germany | 242/132 |
| 2346145 | 3/1975 | Fed. Rep. of Germany | 206/386 |

*Primary Examiner*—Leonard D. Christian

*Attorney, Agent, or Firm*—Cushman, Darby & Cushman

[57] ABSTRACT

A pallet of moldable material, such as high density polyethylene, is ideally suited for transporting yarn packages having tubular cores. The pallet includes top and bottom surfaces with a repeating pattern of nubs upstanding from the top surface and a repeating pattern of depressions in the bottom surface, the depression pattern tracking the nub pattern. The nubs are shaped and dimensioned to receive one end of the yarn package tube thereover, and flexed to provide maximum surface contact with the inside of the tube. The outer surface of the tube also is received within a recess in the top surface surrounding the nub. A number of yarn packages are assembled on a pallet, and an identical pallet is disposed on top of the yarn packages, the depressions in the bottom surface of the top pallet receiving ends of the yarn package cores. The top and bottom pallets cooperate with the yarn package cores to ensure a stable handling unit with very little lateral shifting of yarn packages, and any number of layers may be provided.

24 Claims, 6 Drawing Figures

MODULAR PALLET AND SHIPPING TRAY

BACKGROUND AND SUMMARY OF THE INVENTION

A wide variety of packaging and shipping materials are utilized in industry today for the multiple shipment of discrete products. For instance in the textile industry, common packaging and shipping products include corrogated containers using corrogated separators between layers of products, corrogated containers using two or more formed parts to serve as top and bottom product supports, with different separators between product layers, and pallets specifically designed to ship particular types of products. Yarn packages, having tubular cores, are typically shipped using corrogated material, which results in substantial waste and labor for handling the corrogated materials. If shipped with conventional pallets, yarn packages have a tendency to have substantial lateral shifting, and thus require special handling.

According to the present invention, a pallet is provided that is specifically adapted for transporting yarn packages, or other discrete products having tubular cores, with very little lateral shifting, and in an efficient manner. The pallets according to the present invention are simple and easy to use, are stackable when not in use, and allow layering of a large amount of product.

A typical pallet according to the present invention is made of molded material, such as high density polyethylene, and includes top and bottom substantially planar surfaces. A pattern of nubs upstands from the top surface, and a pattern of depressions is formed on the bottom surface, tracking the pattern of nubs in the top surface. The nubs preferably are surrounded by recesses formed in the top surface, the recesses dimensioned to receive the end of a tube—such as a tubular core for a yarn package—therein. The nubs are shaped and dimensioned to receive the inner surface of the tube thereover, and to provide maximum flexible surface contact with the inside of the tube. The depressions in the bottom surface of the pallet are dimensioned to receive the outside diameter of the tube therein. The cooperation of the nubs and depressions and engaging tubes—such as yarn package cores—extending therebetween, and the tight engagement with the tubes provided by the nubs, ensures very little lateral shifting of the yarn packages and a stable handling unit in general. Any number of layers of yarn packages, and pallets, may be provided.

The pallets also preferably comprise side walls surrounding the top surface, with the side walls each having at least one arcuate portion concentric with a nub, and having a radius from the center of the nub generally comparable to the radius of a yarn package to be received thereby. This further facilitates proper positioning of the yarn packages.

Support for the nubs is provided by internal supports extending concentrically with the depressions into the hollow interiors of the nubs to engage the top surface of the nubs and provide support. The internal supports do not engage all portions of the side walls of the nubs, however, so as to accommodate desired flexing of the nubs.

The invention also relates to a shipping package comprising, in combination, layers of yarn packages bordered at the tops and bottoms thereof by pallets. If desired, bands or plastic shrink film may be utilized to hold the pallets and yarn packages together in the shipping package.

It is the primary object of the present invention to provide a pallet, and a shipping package formed therewith, which prevents lateral shifting of the product associated therewith, and is simple and easy to construct.

This and other objects of the invention will become clear from an inspection of the detailed description of the invention, and from the appended claims.

DETAILED DESCRIPTION OF THE DRAWINGS

Figure 1:
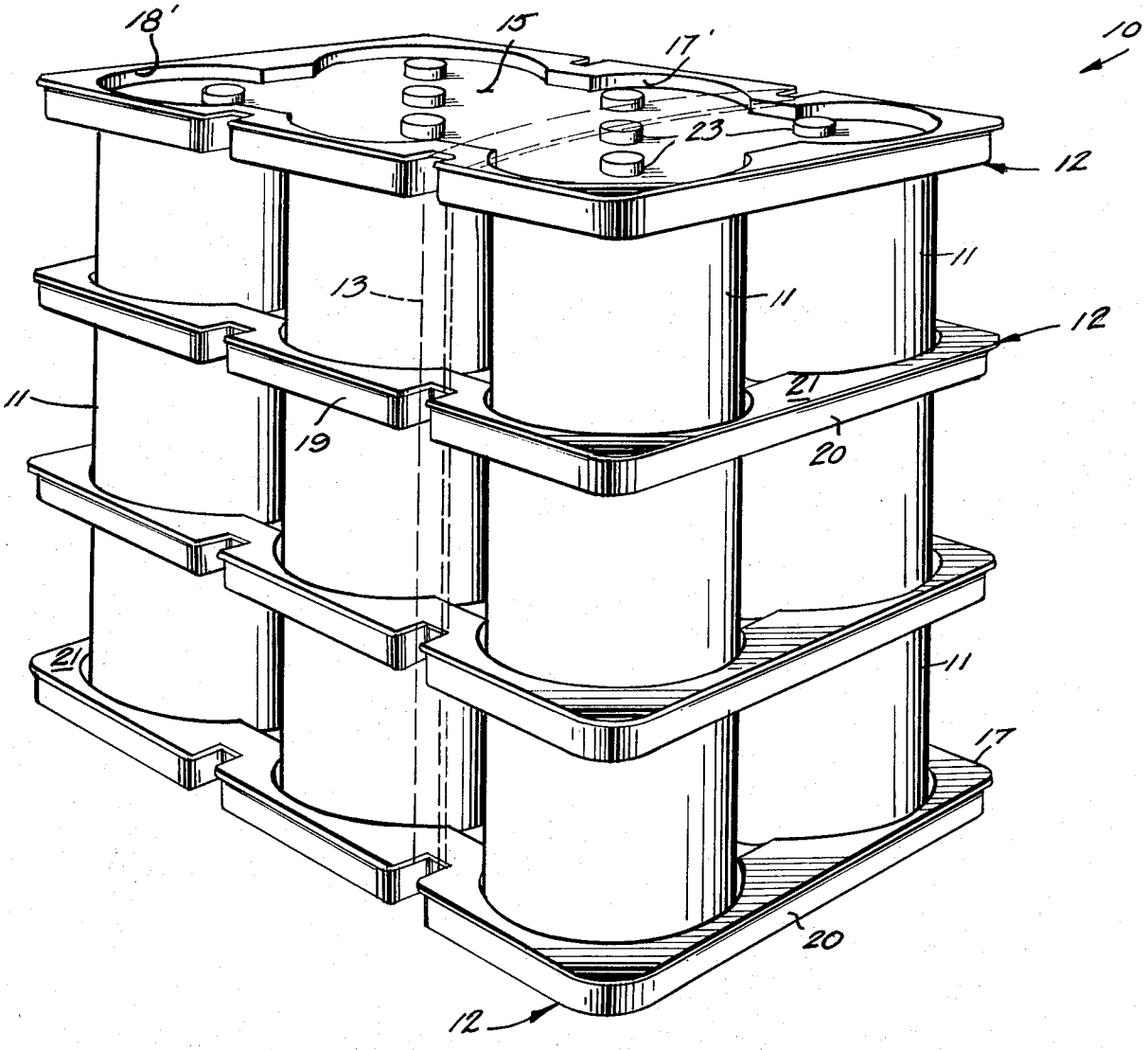
FIG. 1 is a schematic view of an exemplary shipping package according to the present invention, showing layers of yarn packages separated by pallets according to the present invention.

An exemplary shipping package combination according to the present invention is illustrated generally by reference numeral 10 in FIG. 1. The package 10 includes one or more layers of a product, with a plurality of products in each layer, such as a plurality of yarn packages 11 in each layer. The layers of yarn packages 11 are separated from each other, and defined at the tops and bottoms, by pallets 12 according to the present invention. For some uses, the package 10 may be transported exactly as illustrated in FIG. 1, however for long distance transportation or for transportation where difficulties in handling are anticipated, the components of the package may be held together. Typical structures for holding the package components together would include conventional plastic shrink film encompassing all of the components, or one or more conventional steel bands, such as the band illustrated in dotted line and referenced by numeral 13 in FIG. 1.

Figure 2:
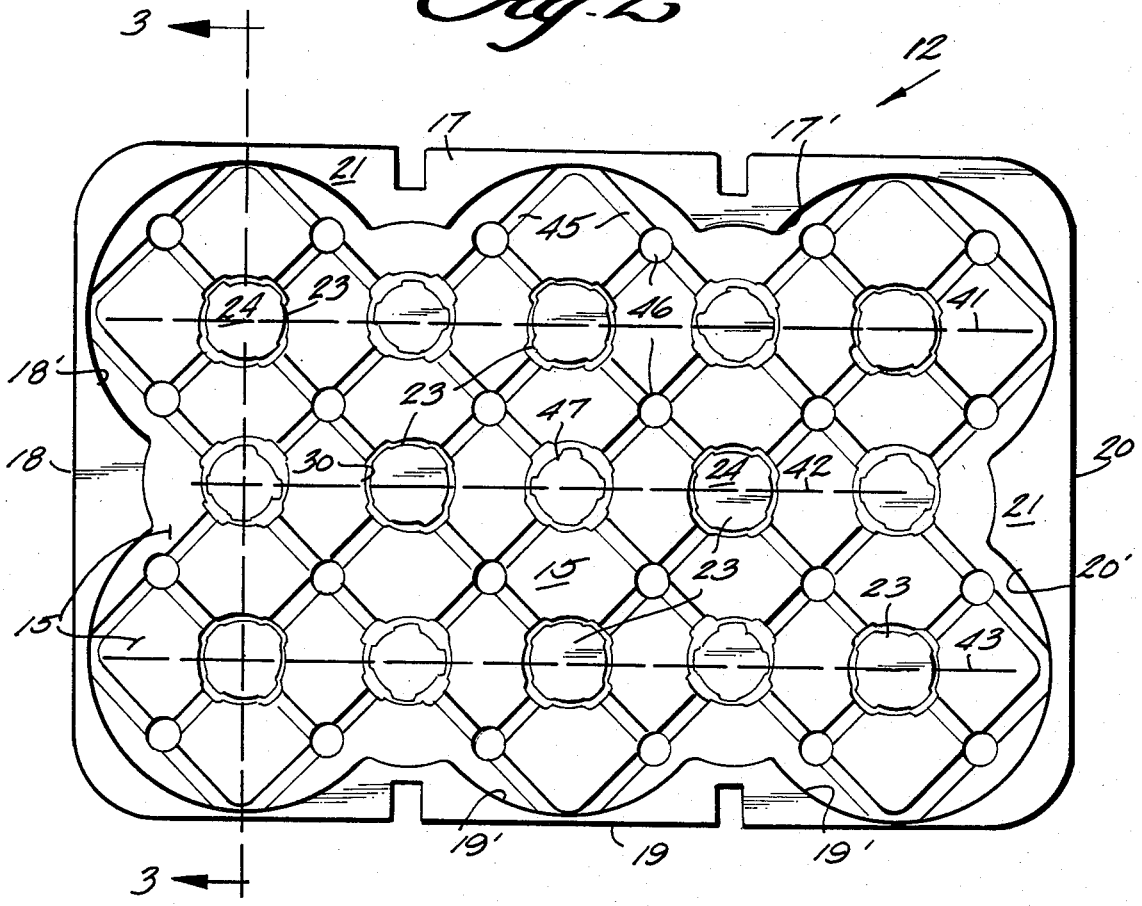
FIG. 2 is a top plan view of one of the pallets illustrated in FIG. 1.
Figure 3:
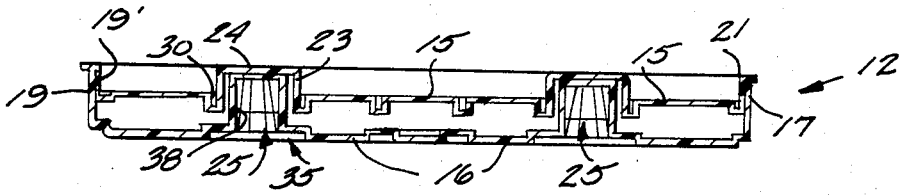
FIG. 3 is a cross-sectional view of the pallet of FIG. 2 taken along lines 3—3 thereof.
Figure 4:
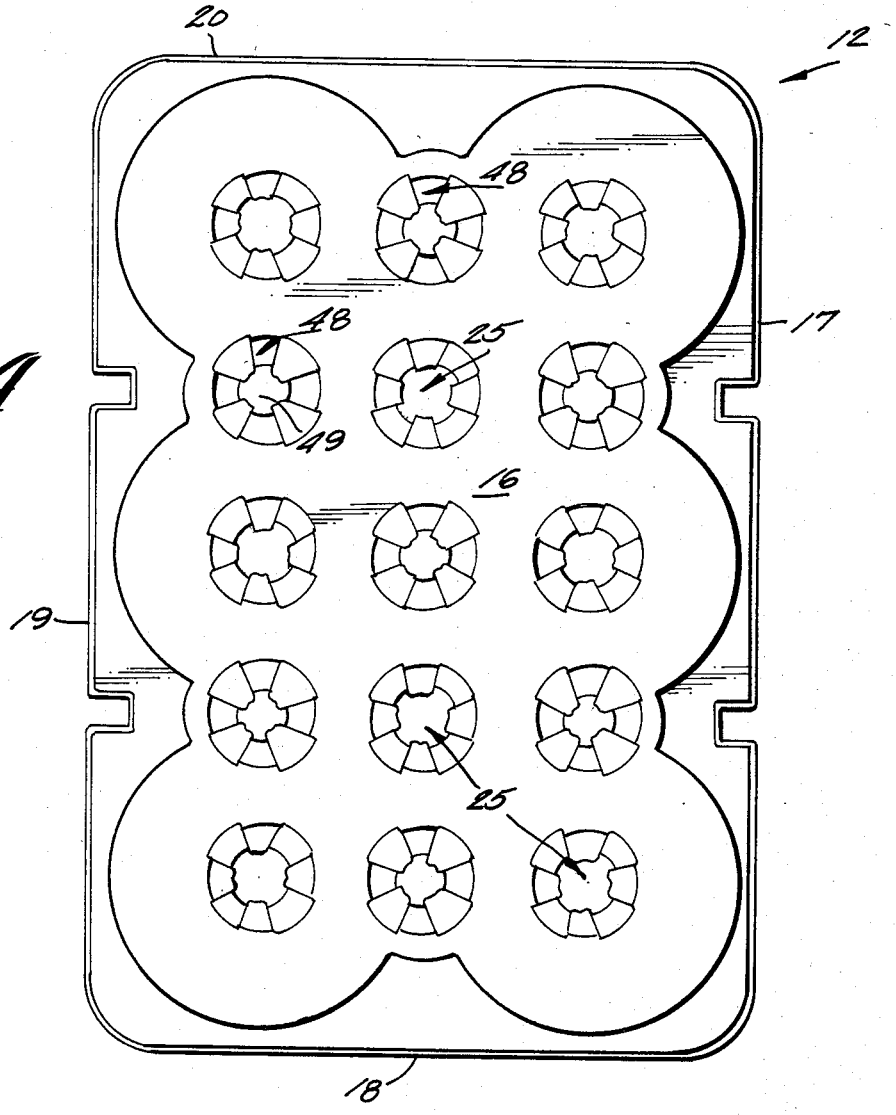
FIG. 4 is a bottom plan view of the pallet of FIG. 2.

An exemplary pallet 12 according to the present invention is illustrated in more detail in FIGS. 2 through 4. The pallet is formed of any moldable material, such as high density polyethylene. The pallet includes a substantially planar top surface 15, and a substantially planar bottom surface 16 spaced from the top surface. The surfaces 15, 16 are substantially parallel.

While the terminology "top" and "bottom" is used in the instant specification and claims, it is to be understood that such use is for reference purposes only and is non-limiting since the pallets 12 may assume a wide variety of orientations during use.

The pallet 12 also preferably comprises side walls 17–20 which encompass the top surface 15. The side walls include top substantially planar portions 21 (see FIG. 2) raised above the top surface 15.

While the pallet 12 may be constructed in a number of manners, one particularly suitable manner is to mold the bottom surface 16 and side walls 17–20 of one piece, and mold top surface 15, interior portions of the side walls 17 through 20, and the planar surfaces 21 as another piece, and then join the pieces together, as with adhesive, by fusing, or in a like manner.

Characteristic of the pallet 12 according to the present invention is a repeating pattern of nubs 23 which upstand from the top surface 15. The nubs 23 each have a generally planar top surface 24 thereof, the surface 24 being substantially coplanar with the surfaces 21. The bottom surface 16 comprises a repeating pattern of depressions 25, the pattern of depressions 25 tracking the pattern of nubs 23 on the top surface 15.

Figure 5:
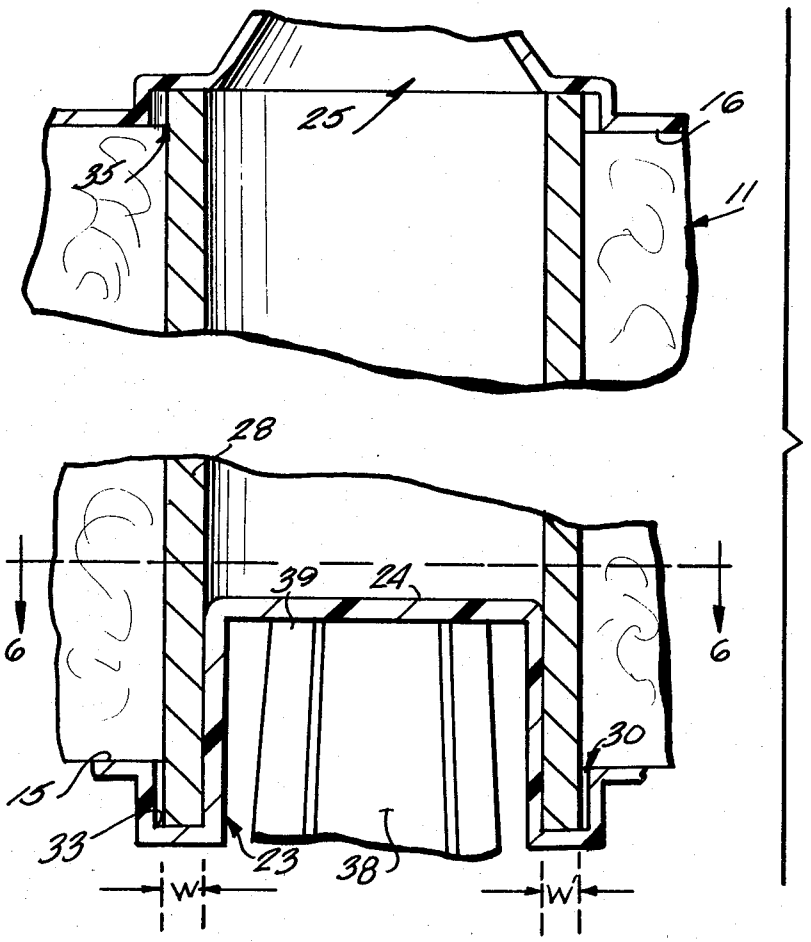
FIG. 5 is a side detail cross-sectional view illustrating the cooperation between top and bottom pallet surfaces and a yarn package mounted thereby in the shipping package of FIG. 1.

The nubs 23 are shaped and dimensioned so as to receive the inner surface of a tube thereover. FIG. 5 illustrates a nub 23 having one end of the tubular core 28 of the yarn package 11 slipped thereover. The nub 23 side walls are dimensioned, shaped, and positioned so that they can flex radially to provide the maximum surface contact on the inside of the tube 28, and thereby positively hold the yarn package 11 in place. The flexing action allows the nubs 23 to properly hold yarn packages 11 even though the inside diameters of the tubes 28 can vary somewhat in practice.

Figure 6:
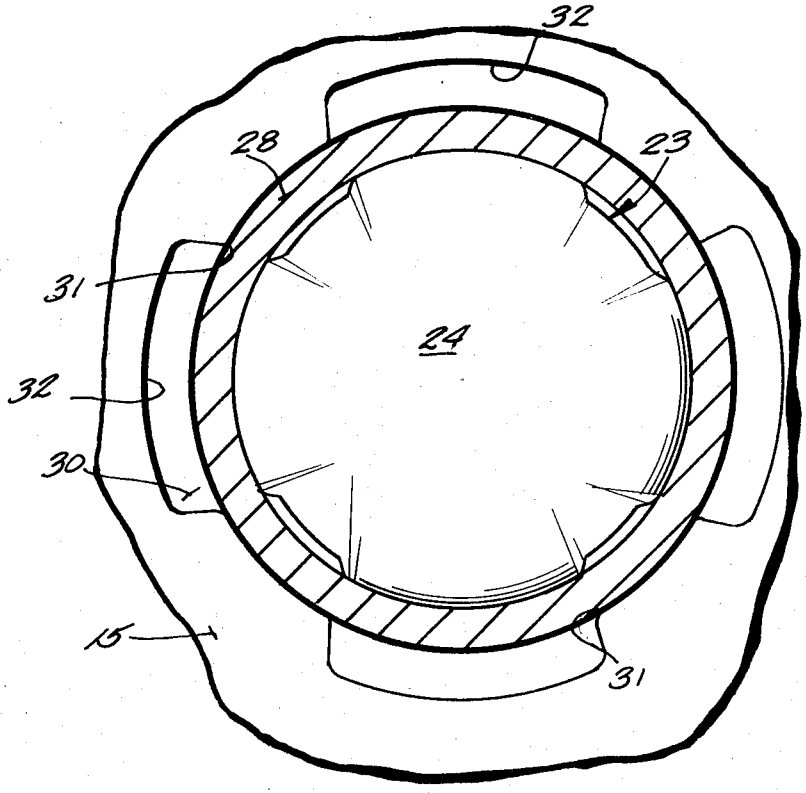
FIG. 6 is a top sectional view taken along lines 6—6 of FIG. 5, and with yarn of the yarn package removed for clarity of illustration.

As seen most clearly in FIG. 6, each projection 23 is formed so that it is generally cylindrical in plan view, however it has flexible side wall portions thereof that make it slightly out-of-round.

Each nub 23 is preferably surrounded by a recess 30 in the upper surface 15. The recess 30 has a width W (see FIG. 5) that is at all points great enough to receive the tube 28, having a thickness W', therein. That is $W \geqq W'$. The recess 30 may be constructed so that some side wall portion —e.g. side wall portion 31 in FIG. 6—thereof are adapted to engage the outer periphery of the tube 28, while other portions—e.g. side wall portion 32 in FIG. 6—thereof are more radially outwardly spaced so as not to be adapted to engage the tube 28 side walls. Preferably the end of tube 28 abuts the bottom surface 33 of the recess 30 as illustrated in FIG. 5.

The depressions 25 formed in the bottom surface 16 have an entry portion 35 thereof (see FIGS. 3 and 5) which is dimensioned so as to receive therein the end of the tube 28 opposite the end engaging the nub 23. The depression 25 also includes an internal support structure 38 (see FIGS. 3 and 5) which is integral with the bottom surface 16. The internal support 38 preferably is in the form of a truncated cone, and is dimensioned so that the top surface 39 thereof engages and supports the top surface 24 of a cooperating nub 23. Note, however, that at least along portions of the side walls of the nub 23, the internal support 38 does not make contact with the side walls of the nub 23, so as not to interfere with desired flexing action of the nub 23 side walls.

In the preferred embodiment of the pallet 12 according to the invention, the side walls 17 through 20 each include at least an interior arcuate portion 17', 18', 19', 20' thereof which is concentric with a nub 23, and has a radius of curvature from the center of the nub 23 that is substantially equal to the radius of the yarn of the yarn package 11 to be received thereby. In this way the side walls 17 through 20 provide further mechanism for preventing lateral shifting of the yarn packages, as can be seen in FIG. 1.

Also as illustrated in the drawings, the nubs 23 preferably are disposed in a pattern comprising at least three rows. The nubs in each row having the centers thereof colinear, and the rows being substantially parallel to each other. In FIG. 2 first, second, and third rows 41, 42, and 43, respectively are illustrated. The nubs 23 within the rows are disposed so that each nub 23 in the second row 42 is equidistant from the adjacent four nubs 23 in the first and second rows 41, 43; that is four nubs 23 in the first and second rows 41, 43 form the corners of a square, and the nub 23 in the second row 42 is at the intersection of the diagonals of the square. In the embodiment illustrated in the drawings the rows 41 and 43 each have three nubs 23, while the row 42 has two nubs.

FIGS. 2 through 4 of the drawings illustrate a number of additional surface manifestations that may be provided in the surfaces 15, 16 of the pallet 12. These surface manifestations, such as the channels 45, depressions 46, and "false" nubs 47 (having the tops thereof even with the surface 15)—as seen in FIG. 2—, and the "false" depressions 48 with central projections 49 having the bottom surfaces thereof even with surface 16 (see FIG. 4), are provided to facilitate strengthening of the surfaces 15, 16 and/or to hold small yarn packages.

In an exemplary manner of construction of a pallet 12 according to the invention, the bottom surface 16 and side walls 17–20 are molded of one piece from a moldable material such as high density polyethylene, and the top surface 15, inner side wall surfaces 17'–20', and flat wall portions 21 are molded into another component. The components are then joined together so that the top surfaces 39 of the internal supports 38 extend into the hollow interiors of the nubs 23 and engage the top surfaces 24 thereof, and the components are joined together as by fusing the side walls 17–20 to the bottoms of the surfaces 21.

In an exemplary manner of use of the pallets 12 in the construction of a package 10 according to the invention, a bottom pallet 12 is provided with a top surface 15 thereof facing upwardly, and six yarn packages 11 are brought into operative association therewith, with one end of the tubular core 28 of each of the yarn packages 26 sliding into engagement so that it frictionally engages the side walls of a nub 23 in row 41 or row 43 while being received within a recess 30. The inner side walls 17'–20' define locating mechanisms for the yarn package 11 exterior portions themselves. Then another pallet 12 is placed on top of the six yarn packages, with the bottom surface 16 of that pallet 12 cooperating with the yarn packages so that the entries 35 to the depressions 25 thereof each receive a package core 28 end therein. This action can be repeated for any desired height, and then straps 13, a plastic shrink film, or the like, can be utilized to bind all of the components together.

Note that where relatively small yarn packages are to be handled, the yarn package may be provided in association with each of the eight nubs on each pallet 12. Also, where only one layer of packages 12 is to be provided, the pallets 12 defining the tops and bottoms of the layer may face each other so that both ends of each yarn tube 28 engages a nub 23.

It will thus be seen that according to the present invention a pallet, and a package utilizing the same, has been provided which substantially prevents lateral shifting of the packages, such as yarn packages, held thereby, is easy to construct, and can be used to form package combinations of a variety of sizes.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A pallet formed of two sheets of fused, molded material, comprising:

a generally planar top surface, and a generally planar bottom surface sufficiently spaced from the said top surface to provide a rigid pallet, said top surface formed by one of said sheets and said bottom surface by the other of said sheets;

a pattern of nubs upstanding from said top surface, each nub surrounded by a recess in said top surface;

a pattern of depressions formed on said bottom surface, said pattern of depressions tracking said pattern of nubs upstanding from said top surface;

each of said nubs shaped and dimensioned to receive the inner surface of a first tube thereover, and provide maximum resilient surface contact with the inside of the first tube when a bottom portion of the tube is received in said recess surrounding said nub; and each depression in said bottom surface dimensioned to receive another tube substantially indentical to said first tube therein.

2. A pallet as recited in claim 1 further comprising side walls encompassing said top surface, said side walls having substantially planar top portions which are raised above said top surface a distance substantially equal to the distance said nubs extend over said top surface.

3. A pallet as recited in claim 2 wherein each of said side walls includes at least one inner surface portion thereof having an arcuate shape concentric with the center of one of said nubs.

4. A pallet as recited in claim 3 wherein said pattern of nubs comprises at least first, second, and third generally parallel rows of nubs, the nubs of the first and third rows being generally in alignment with each other, and the nub or nubs of the second row disposed essentially equidistant from adjacent nubs in both said first and third rows.

5. A pallet as recited in claim 4 wherein said pattern of nubs consists of said first, second, and third rows, three nubs being disposed in each of said first and third rows, and two nubs being disposed in said second row.

6. A pallet as recited in claim 3 further comprising a support component disposed interiorly of each of said nubs, said support component extending from a depression in said bottom surface aligned with said nub, and having a surface abutting a top surface of said nub and providing support thereto, and having side surface portions spaced from at least first portions of the sides of said nub.

7. A pallet as recited in claim 6 wherein said first portions of the side of said nub are radially flexible.

8. A pallet as recited in claim 7 wherein each of said recesses includes first side wall portions dimensioned to abut a tube received by said recess, and second wall portions radially spaced outwardly from said first wall portions.

9. A pallet as recited in claim 7 wherein said molded material is high density polyethylene.

10. A pallet as recited in claim 7 wherein said top surface and said bottom surface are formed from separate sheets of molded material joined together at said side walls.

11. A pallet as recited in claim 1 further comprising a support component disposed interiorly of each of said nubs, said support component extending from a depression in said bottom surface aligned with said nub, and having a surface abutting a top surface of said nub and providing support thereto, and having side surface portions spaced from at least first portions of the sides of said nub.

12. A pallet as recited in claim 11 wherein said first portions of the side of said nub are radially flexible.

13. A pallet of molded material, and comprising:

a generally planar top surface, and a generally planar bottom surface spaced from said top surface;

a pattern of nubs upstanding from said top surface;

a pattern of depressions formed on said bottom surface, said pattern of depressions tracking said pattern of nubs upstanding from said top surface;

each of said nubs shaped and dimensioned to receive the inner surface of a tube thereover, and provide maximum resilient surface contact with the inside of the tube; and a support component disposed interiorly of each of said nubs, said support component extending from a depression in said bottom surface aligned with said nub, and having a surface abutting a top surface of said nub and providing support thereto, and having side surface portions spaced from at least first portions of the sides of said nub.

14. A pallet as recited in claim 13 wherein said first portions of the side of said nub are radially flexible.

15. A pallet as recited in claim 14 wherein said interior support is a truncated cone.

16. A pallet as recited in claim 14 wherein each of said nubs, in plan view, is generally in the form of a cylinder with said first, radially flexible portions, making the cylinder slightly out-of-round.

17. A pallet as recited in claim 16 wherein each of said nubs includes four of said spaced, radially flexible portions.

18. A shipping package combination comprising:

a plurality of yarn packages, each having a cylindrical tubular core having predetermined inside and outside diameters, with first and second ends thereof extending outwardly from the yarn of said yarn package;

a pallet of molded material, and comprising: top and bottom surfaces; a pattern of nubs upstanding from said top surface; a pattern of depressions formed in said bottom surface and tracking the nubs in said top surface;

each of said nubs shaped and dimensioned to receive the inner surface of said first end of one of said tubes thereover, and provide frictional engagement with said inner surface;

a second pallet substantially identical to said first pallet; and said second pallet being disposed with respect to said first pallet and said yarn packages so that a depression in the bottom surface of said second pallet is in alignment with a nub upstanding from the top surface of said first pallet, said depression receiving therewithin the outside diameter of the second end of said tube received by said corresponding nub of said pallet.

19. A shipping package combination as recited in claim 18 wherein each of said pallets comprises side walls surrounding said top surface, said side walls having a top substantially planar surface substantially coplanar with the tops of said nubs upstanding from said first surface; and wherein each of said side walls includes at least one interior arcuate portion concentric with one of said nubs and having a radius substantially equal to, but slightly greater than, the radius of one of said yarn packages.

20. A shipping package combination as recited in claim 18 further comprising a support component disposed interiorly of each of said nubs, said support component extending from a depression in said bottom surface aligned with said nub, and having a surface abutting a top surface of said nub and providing support thereto, and having side surface portions spaced from at least first portions of the sides of said nub; wherein said first portions of the side of said nub are radially flexible.

21. A pallet of molded material comprising:

top and bottom surfaces; said top surface formed by a first sheet of molded material, and said bottom surface formed by a second sheet of molded material, and said first and second sheets fused together so as to provide a rigid pallet;

a pattern of nubs upstanding from said top surface, each of said nubs extending above said top surface a predetermined amount;

side walls surrounding said top surface and having substantially planar top portions thereof essentially coplanar with the tops of said nubs; and said nubs shaped and dimensioned to receive the inner surface of a tube thereover and to flex to provide maximum frictional engagement with the inside of the tube along the entire height of each of said nubs.

22. A pallet as recited in claim 21 wherein said side walls are formed by portions of said second sheet.

23. A pallet as recited in claim 22 wherein said side walls are further formed by portions of said first sheet.

24. A pallet of molded material, comprising:

a generally planar top surface, and a generally planar bottom surface spaced from said top surface;

a pattern of nubs upstanding from said top surface, each nub surrounded by a recess in said top surface;

a pattern of depressions formed on said bottom surface, said pattern of depressions tracking said pattern of nubs upstanding from said top surface;

each of said nubs shaped and dimensioned to receive the inner surface of a first tube thereover, and provide maximum resilient surface contact with the inside of the first tube when a bottom portion of the tube is received in said recess surrounding each nub;

each depression in said bottom surface dimensioned to receive a second tube, substantially identical to said first tube, therein; and side walls encompassing said top surface, said side walls having substantially planar top portions which are raised above said top surface a distance substantially equal to the distance said nubs extend over said top surface, and each of said side walls including at least one inner surface portion thereof having an arcuate shape concentric with the center of one of said nubs.

* * * * *